US008336527B2

(12) United States Patent
Aso et al.

(10) Patent No.: US 8,336,527 B2
(45) Date of Patent: Dec. 25, 2012

(54) EVAPORATED FUEL PROCESSING DEVICE

(75) Inventors: Shuichi Aso, Toyota (JP); Takashi Nagai, Handa (JP)

(73) Assignee: Aisan Kogyo Kabushiki Kaisha, Obu-shi (JP)

( * ) Notice: Subject to any disclaimer, the term of this patent is extended or adjusted under 35 U.S.C. 154(b) by 161 days.

(21) Appl. No.: 12/950,206

(22) Filed: Nov. 19, 2010

(65) Prior Publication Data

US 2011/0120425 A1 May 26, 2011

(30) Foreign Application Priority Data

Nov. 24, 2009 (JP) ..... 2009-266747

(51) Int. Cl.
*F02M 33/02* (2006.01)

(52) U.S. Cl. ..... 123/519; 123/520

(58) Field of Classification Search ..... 123/516, 123/518, 519, 520
See application file for complete search history.

(56) References Cited

U.S. PATENT DOCUMENTS

| | | | | |
|---|---|---|---|---|
| 5,957,113 | A * | 9/1999 | Masaki et al. | 123/518 |
| 6,772,740 | B2 * | 8/2004 | Kojima et al. | 123/519 |
| 2003/0196645 | A1 * | 10/2003 | Kojima et al. | 123/520 |
| 2008/0308072 | A1 * | 12/2008 | Banerjee et al. | 123/518 |

FOREIGN PATENT DOCUMENTS

| | | | |
|---|---|---|---|
| JP | 2003314478 | A | 11/2003 |
| JP | 2004353600 | A | 12/2004 |

OTHER PUBLICATIONS

English Abstract of JP 2003314478.
English Abstract of JP 2004353600.

* cited by examiner

*Primary Examiner* — Thomas Moulis
(74) *Attorney, Agent, or Firm* — Banner & Witcoff, Ltd.

(57) ABSTRACT

A solenoid switching valve is provided at a low concentration gas pipe that sends gas from a second separating film unit to a canister. A reflux pipe, that is branched-off from the low concentration gas pipe by the solenoid switching valve, merges with a medium concentration gas pipe that is from the second separating film unit, and further runs via a circulating pipe, and reaches a merge portion with a purge pipe from the canister. By switching the solenoid switching valve to the merge portion side and driving a purge pump that is provided at an exhaust pipe between the merge portion and a first separating film unit, gas, whose concentration has risen within the low concentration gas pipe, is sent to the first separating film unit, and is separated into high concentration gas HG and low concentration gas LG.

5 Claims, 5 Drawing Sheets

EVAPORATED FUEL PROCESSING DEVICE

RELATED APPLICATION

This application claims priority under 35 USC 119 from Japanese Patent Application No. 2009-266747, filed on Nov. 24, 2009, the disclosure of which is incorporated by reference herein.

BACKGROUND OF THE INVENTION

1. Field of the Invention

The present invention relates to an evaporated fuel processing device for processing evaporated fuel.

2. Description of the Related Art

As an evaporated fuel processing device for processing evaporated fuel that is generated in a fuel tank provided in a vehicle such as an automobile or the like, Japanese Patent Application Laid-Open (JP-A) No. 2004-353600 for example discloses a structure in which gas that flows-out from a canister is made to pass through two separating units in order, and the high concentration gas is returned to the fuel tank, and the low concentration gas is returned to the canister.

In the structure disclosed in JP-A No. 2004-353600, the low concentration gas that is exhausted from the second (the latter stage) separating unit is directly sent to the canister. However, there are cases in which, in the pipe (passage) from the second separating unit to the canister, the low concentration gas stays while, for example, the evaporated fuel processing device is stopped, and therefore, the gas gradually becomes high concentration. Then, when the evaporated fuel processing device is started-up, the evaporated fuel that has become high concentration is sent to the canister, and the canister may be polluted.

SUMMARY OF THE INVENTION

In view of the above-described circumstances, a topic of the present invention is to provide an evaporated fuel processing device that can suppress the sending of gas, that has a high concentration of evaporated fuel, to a canister and the polluting of the canister.

An evaporated fuel processing device of a first aspect of the present invention includes: a fuel tank that can accommodate fuel; a canister carrying out, by an adsorbent, adsorption and purging of evaporated fuel generated within the fuel tank; a first separating unit that separates gas, which contains the evaporated fuel that is introduced from the canister or the fuel tank, into a high concentration component gas whose fuel concentration is relatively high and a low concentration component gas whose fuel concentration is relatively low; a tank return flow path for returning, to an interior of the fuel tank, the high concentration component gas generated at the first separating unit; a communication flow path for exhausting, to an exterior of the first separating unit, the low concentration component gas generated at the first separating unit; a second separating unit that further separates the low concentration component gas, which is introduced from the communication flow path, into another high concentration component gas whose fuel concentration is relatively high and another low concentration component gas whose fuel concentration is relatively low; a purging flow path for sending the other low concentration component gas, that is generated at the second separating unit, to the canister as vapor for purging; an evaporated fuel return flow path that is branched-off from the purging flow path by a branch portion, and that is for returning, to the first separating unit, gas that contains evaporated fuel within the purging flow path; a switching valve that switches a flow path of vapor that is downstream of the branch portion, between the purging flow path and the evaporated fuel return flow path; and a returning pump that pressurizes gas, which flows through the evaporated fuel return flow path, and that sends the gas to the first separating unit.

At the evaporated fuel processing device, adsorption and purging (desorption) of evaporated fuel that is generated within the fuel tank can be carried out by the adsorbent of the canister. Further, the gas, that includes the evaporated fuel introduced from the canister or the fuel tank, is separated, by the first separating unit, into a high concentration component gas whose fuel concentration is relatively high (hereinafter called "high concentration gas") and a low concentration component gas whose fuel concentration is relatively low (hereinafter called "medium concentration gas" because this component gas has a higher concentration than low concentration gas whose fuel concentration is relatively low and that is generated at the second separating unit as described below). Then, the high concentration gas is subjected to processing such as concentrating or the like for example, and passes through the tank return flow path and can be liquefied and recovered within the fuel tank. Further, the medium concentration gas passes through the communication flow path and is introduced into the second separating unit, and is separated into a relatively high concentration component gas (this component gas also is called "medium concentration gas" for convenience) and a low concentration component gas (low concentration gas).

Here, in the present invention, by switching the switching valve to the side of the purging flow path, the low concentration gas that is generated at the second separating unit can be sent to the canister through the purging flow path. Then, purging of the evaporated fuel that is adsorbed within the canister can be carried out by using this low concentration gas as vapor for purging.

Further, by switching the switching valve to the side of the evaporated fuel return flow path and driving the pump for return, the gas, that contains the evaporated fuel existing within the purging flow path, can be returned to the first separating unit through the evaporated fuel return flow path. For example, even when low concentration gas stays within the purging flow path and becomes high concentration gas, this high concentration gas can be made into low concentration gas by using the first separating unit (and further using the second separating unit). By switching the switching valve to the purging flow path side and sending the low concentration gas that is generated in this way to the canister, purging of the evaporated fuel that is adsorbed within the canister can be carried out by using the low concentration gas. Gas that has become high concentration is not sent into the canister, and polluting of the canister can be suppressed.

In the evaporated fuel processing device of the first aspect of the present invention, the switching valve may be a three-way valve that is provided at the branch portion.

Accordingly, as compared with a structure in which valves are provided respectively at the evaporated fuel return flow path and the purging flow path downstream of the branch portion, the single three-way valve suffices as the switching valve, and therefore, the structure can be simplified.

The evaporated fuel processing device of the first aspect of the present invention may further include: a tank exhaust flow path for exhausting gas, that contains evaporated fuel within the fuel tank, to an exterior of the fuel tank and sends the gas to the first separating unit; and a sending pump that pressurizes gas, which flows through the tank exhaust flow path, and that sends the gas to the first separating unit, wherein the evaporated fuel return flow path merges with the tank exhaust flow path at an upstream side of the sending pump. The sending pump may also serve as the returning pump.

Due thereto, the gas, that includes the evaporated fuel generated within the fuel tank, is pressurized by the sending pump, is introduced from the tank exhaust flow path into the first separating unit, and can be separated into high concentration gas and medium concentration gas. The medium concentration gas is further introduced into the second separating unit, and can be separated into medium concentration gas and low concentration gas.

The evaporated fuel return flow path merges with the tank exhaust flow path at the upstream side of the sending pump, and the sending pump also serves as the returning pump. Further, a portion of the tank exhaust flow path also serves as a portion of the evaporated fuel return flow path. For these reasons, the structure of the evaporated fuel processing device can be simplified.

The evaporated fuel processing device of the first aspect of the present invention may further include: an intermediate gas return flow path for returning, to the first separating unit, the low concentration component gas generated at the first separating unit; and an opening/closing valve that is provided at the intermediate gas return flow path and that opens and closes the intermediate gas return flow path, wherein the intermediate gas return flow path merges with the tank exhaust flow path at an upstream side of the sending pump.

In the above-described structure, the medium gas return flow path merges with the tank exhaust flow path at the upstream side of the sending pump. Therefore, by opening the opening/closing valve and driving the sending pump, the medium concentration gas generated at the first separating unit is, without being sent to the second separating unit, introduced into the first separating unit again and can be separated or liquefied and recovered. Because the medium concentration gas is not sent to the second separating unit, the pressure of the evaporated fuel can be lowered by that much. The energy (electric power) required for driving the pump for return can be reduced, and evaporated fuel can be efficiently separated into high concentration gas and low concentration gas.

Due to the above-described structure, the present invention can suppress polluting of a canister due to vapor, whose concentration of evaporated fuel is high, being sent to the canister.

DETAILED DESCRIPTION OF THE INVENTION

Figure 1:
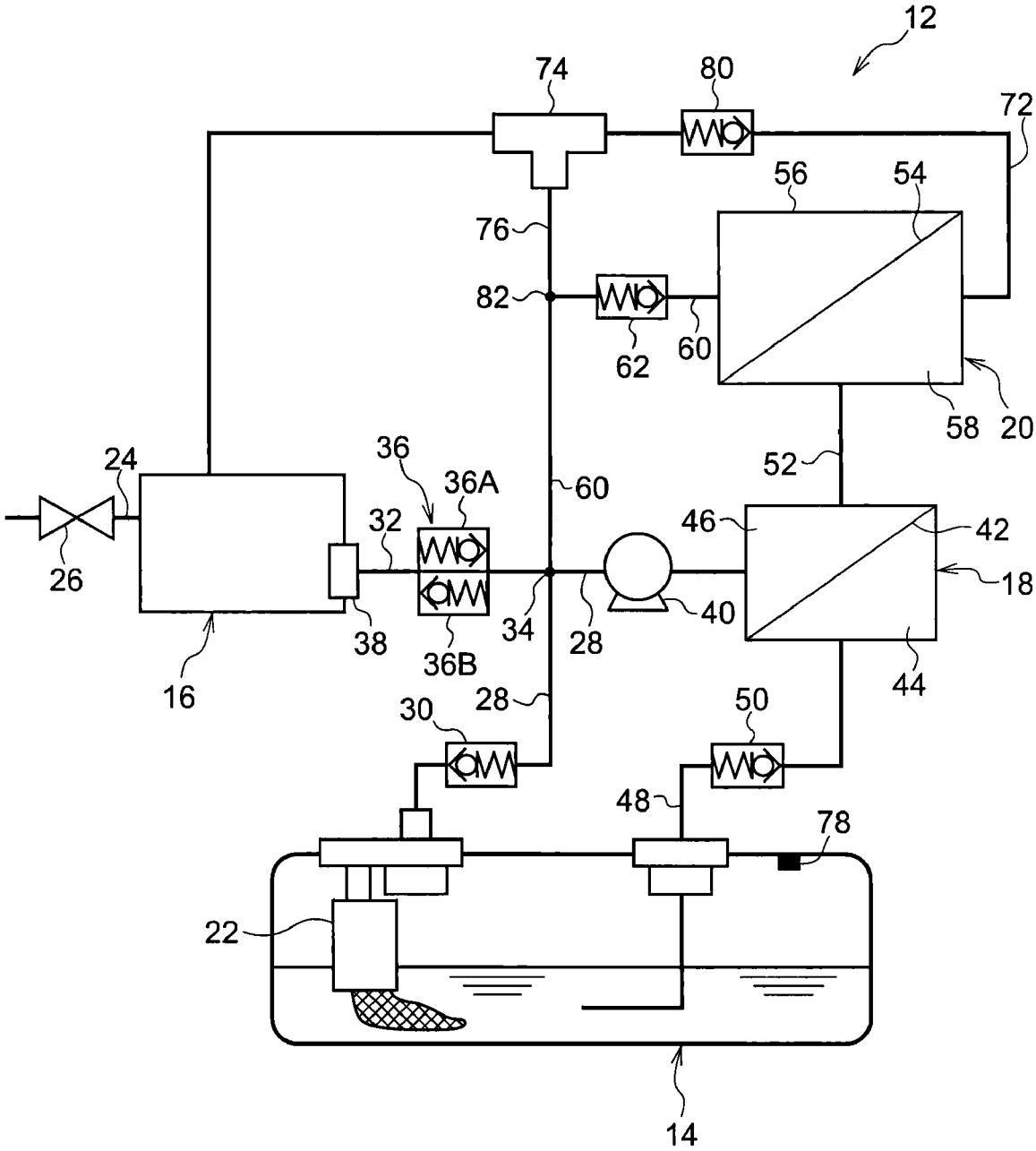
FIG. 1 is a schematic structural drawing showing an evaporated fuel processing device of a first exemplary embodiment of the present invention.

The schematic structure of an evaporated fuel processing device 12 of a first exemplary embodiment of the present invention is shown in FIG. 1. The evaporated fuel processing device 12 has a fuel tank 14, a canister 16, a first separating film unit 18, and a second separating film unit 20. A fuel pump 22 is provided at the fuel tank 14. Due to the fuel pump 22 being driven by an unillustrated ECU, fuel that is accommodated within the fuel tank 14 can be supplied to an unillustrated engine.

Active carbon that serves as an adsorbent is accommodated within the canister 16. The evaporated fuel that is generated within the fuel tank 14 can be adsorbed by the active carbon of the canister 16, and the adsorbed evaporated fuel can be purged.

One end of a vent pipe 24 is connected to the canister 16, and the other end of the vent pipe 24 is open to the atmosphere. A solenoid open valve 26, whose opening and closing is controlled by the unillustrated ECU, is provided at the vent pipe 24.

An exhaust pipe 28, for exhausting the evaporated fuel within the fuel tank 14 to the exterior of the fuel tank 14, extends from the fuel tank 14 and is connected to a low concentration chamber 46 of the first separating film unit 18. A tank check valve 30, that allows movement of gas from the fuel tank 14 toward the first separating film unit 18 and impedes movement in the opposite direction, is provided at the exhaust pipe 28. The evaporated fuel within the fuel tank 14 can be sent through the exhaust pipe 28 to the low concentration chamber 46 of the first separating film unit 18.

A purge pipe 32 extends from the canister 16, and merges with the exhaust pipe 28 at a merge portion 34. The portion substantially from the merge portion 34 to the first separating film unit 18 serves as both the exhaust pipe 28 and the purge pipe 32. Further, a check valve pair 36 at which are provided both a check valve 36A, that permits only movement of gas from the merge portion 34 toward the canister 16, and a check valve 36B, that permits only movement of gas in the opposite direction, is provided at the purge pipe 32. Due thereto, when the internal pressure of the fuel tank 14 exceeds the valve opening pressure of the check valve 36A, evaporated fuel can be sent from the fuel tank 14 to the canister 16. Further, by the driving of a purge pump 40 that is described below, gas EG that includes evaporated fuel can be sent from the canister 16 to the first separating film unit 18.

A concentration detector 38, that can detect the concentration of evaporated fuel within the gas EG that is exhausted from the canister 16, is provided at the portion of the canister 16 that is connected to the purge pipe 32. The concentration detector 38 sends detected concentration data to the unillustrated ECU.

The purge pump 40, that is controlled by the unillustrated ECU, is provided between the merge portion 34 and the first separating film unit 18. The purge pump 40 structures the "sending pump" in the present invention. By driving the purge pump 40, the gas EG that includes evaporated fuel can be actively sent to the first separating film unit 18.

The interior of the first separating film unit 18 is sectioned by a first separating film 42, and a high concentration chamber 44 and the low concentration chamber 46 are provided. The first separating film 42 is a thin-film-shaped member that is formed of a polymer material (e.g., polyimide or the like). When gas that contains air and evaporated fuel contacts the first separating film 42, the first separating film 42 can separate them due to the difference between the solubility of air and the solubility of evaporated fuel with respect to the first separating film 42. In the example shown in FIG. 1, when gas that includes evaporated fuel is introduced into the low concentration chamber 46 in a high pressure state of greater than or equal to a predetermined value, a pressure difference arises at the both sides of the first separating film 42, and the evaporated fuel is separated such that a relatively high concentration component (hereinafter, this relatively high concentration component is called "high concentration gas HG") passes through toward the low pressure side (the high concentration chamber 44), and, at the high pressure side (the low concentration chamber 46), the evaporated fuel becomes a relatively low concentration component (hereinafter, this relatively low concentration component is called "medium concentration gas MG").

A return pipe 48 provided with a high concentration gas check valve 50 is connected between the high concentration chamber 44 of the first separating film unit 18 and the fuel tank 14. The high concentration gas HG that is generated at the first separating film unit 18 is condensed and liquefied by, for example, an unillustrated condensing mechanism or the like that is provided further toward the fuel tank 14 side than the high concentration gas check valve 50, and is refluxed to the fuel tank 14 and liquefied and recovered.

A communicating pipe 52 extends from the first separating film unit 18, and is connected to the second separating film unit 20. The medium concentration gas MG that is generated at the first separating film unit 18 can be sent to a low concentration chamber 58 of the second separating film unit 20.

In the same way as the first separating film unit 18, the interior of the second separating film unit 20 is sectioned by a second separating film 54, and a high concentration chamber 56 and the low concentration chamber 58 are provided. In the same way as the first separating film 42, the second separating film 54 is a thin-film-shaped member that is formed of a polymer material (e.g., polyimide or the like). When gas that contains air and evaporated fuel contacts the second separating film 54, the second separating film 54 can separate them due to the difference between the solubility of air and the solubility of evaporated fuel. In the example shown in FIG. 1, when gas that includes evaporated fuel is introduced into the low concentration chamber 58 in a high pressure state of greater than or equal to a predetermined value, a pressure difference arises at the both sides of the second separating film 54, and the evaporated fuel is separated such that the relatively high concentration component (hereinafter, this relatively high concentration component is called "medium concentration gas MG" for convenience because, although it is a higher concentration that the previously-mentioned medium concentration gas MG, the concentration thereof is lower than the high concentration gas HG) is transmitted toward the low pressure side (the high concentration chamber 56), and, at the high pressure side (the low concentration chamber 58), the evaporated fuel becomes a relatively low concentration component (hereinafter, this relatively low concentration component is called "low concentration gas LG").

A low concentration gas pipe 72 is connected between the low concentration chamber 58 of the second separating film unit 20 and the canister 16. A low concentration gas check valve 80, that permits only movement of gas from the second separating film unit 20 toward the canister 16 and inhibits movement of the gas in the opposite direction, is provided at the low concentration gas pipe 72. The low concentration gas LG is sent to the canister 16.

A circulation pipe 60 extends from the high concentration chamber 56 of the second separating film unit 20, and is connected to the merge portion 34. A circulation check valve 62 is provided at the circulation pipe 60. The medium concentration gas MG that is generated at the second separating film unit 20 can be sent to the first separating film unit 18 through the circulation pipe 60, the merge portion 34 and the exhaust pipe 28, but flow thereof in the opposite direction is impeded.

A solenoid switching valve 74 is provided at the intermediate portion of the low concentration gas pipe 72. A merge portion 82, that is set at the intermediate portion of the circulation pipe 60, and the solenoid switching valve 74 are connected by a reflux pipe 76. The reflux pipe 76 substantially arrives at the merge portion 34 through the circulating pipe 60 from the merge portion 82, and is connected to the exhaust pipe 28 (the purge pipe 32) at the upstream side of the purge pump 40.

The solenoid switching valve 74 is a three-way valve that is controlled by the unillustrated ECU, and selectively sends gas, that contains evaporated fuel that was sent from the low concentration chamber 58 of the second separating film unit 20, toward either of the canister 16 side or the merge portion 82 side. When the solenoid switching valve 74 is switched to the canister 16 side, the gas containing the evaporated fuel that was generated at the low concentration chamber 58 is sent as is to the canister. When the solenoid switching valve 74 is switched to the merge portion 34 side, when the purge pump 40 is driven, the gas containing the evaporated fuel that was generated at the low concentration chamber 58 is sent from the circulation pipe 60 through the exhaust pipe 28 to the first separating film unit 18. The purge pump 40 also functions as the "return pump" in the present invention.

A temperature sensor 78 is provided in the fuel tank 14 as well. The temperature data detected by the temperature sensor 78 is sent to the unillustrated ECU. The ECU can estimate the concentration of the evaporated fuel within the fuel tank 14 from the state of traveling of the vehicle, the driving time of the purge pump at the time of purging the canister 16, the concentration detected at the concentration detector 38, and the like.

The operation and effects of the evaporated fuel processing device 12 of the present exemplary embodiment are described next.

When fueling is carried out at the fuel tank 14, gas of an amount corresponding to the volume of the fuel that is supplied must be exhausted to the exterior of the fuel tank 14. Here, the unillustrated ECU stops driving of the purge pump 40, and opens the solenoid open valve 26. Accordingly, the gas (in which air and evaporated fuel are mixed together) within the fuel tank 14 is exhausted from the exhaust pipe 28, and flows into the canister 16 via the purge pipe 32. Due thereto, fueling into the fuel tank 14 can be carried out continuously. Further, the evaporated fuel within the gas is adsorbed by the adsorbent within the canister 16, and the remaining gas (substantially, air that hardly contains any evaporated fuel) is exhausted to the atmosphere. Therefore, casual releasing of evaporated fuel into the atmosphere is suppressed.

Figure 2:
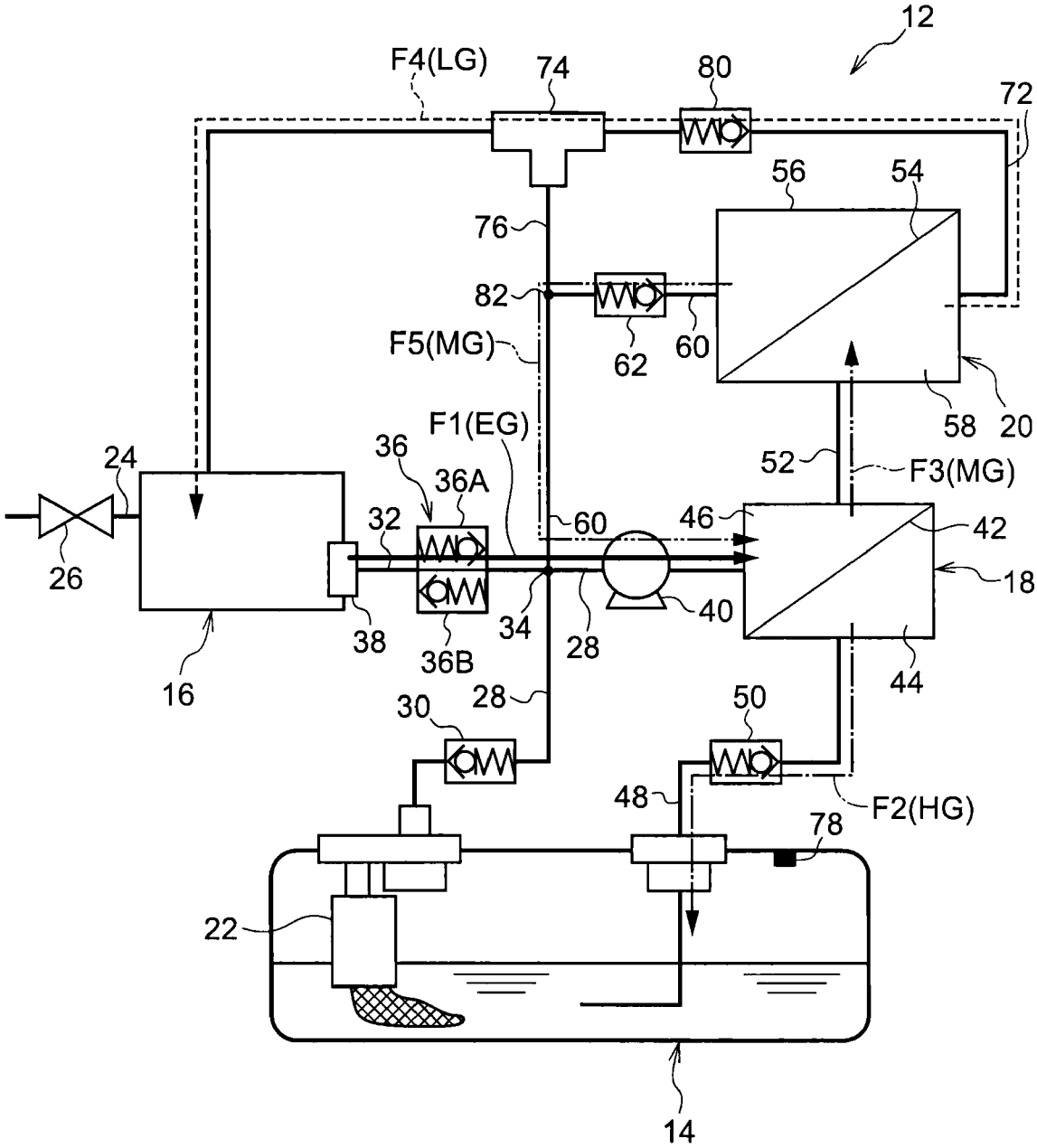
FIG. 2 is a schematic structural drawing showing the evaporated fuel processing device of the first exemplary embodiment of the present invention, together with the flow of gas in a state of processing the evaporated fuel.

When the ECU drives the purge pump 40, as shown by solid line arrow F1 in FIG. 2, the gas EG, that contains evaporated fuel adsorbed by the adsorbent of the canister 16, is sent through the purge pipe 32 and the exhaust pipe 28 (the portion from the merge portion 34 to the first separating film unit 18 that substantially also serves as the purge pipe 32) to the low concentration chamber 46 of the first separating film unit 18. At the first separating film unit 18, this gas is separated into the high concentration gas HG and the medium concentration gas MG. The high concentration gas HG is returned to the fuel tank 14 by the return pipe 48 as shown by one-dot chain line arrow F2.

Here, the medium concentration gas MG that is generated at the first separating film unit 18 is sent through the communication pipe 52 to the low concentration chamber 58 of the second separating film unit 20, as shown by two-dot chain line arrow F3.

At the second separating film unit 20, the gas is further separated into the low concentration gas LG and the medium concentration gas MG. Here, when the ECU switches the solenoid switching valve 74 to the canister 16 side, the low concentration gas LG is sent to the canister 16 as shown by dashed-line arrow F4. Therefore, the evaporated fuel, that was adsorbed by the adsorbent within the canister 16 is purged by this low concentration gas LG. Further, the medium concentration gas MG is sent from the circulating pipe 60 through the merge portion 34 and the exhaust pipe 28 (the portion that also serves as the purge pipe 32) to the low concentration chamber 46 of the first separating film unit 18, as shown by two-dot chain line arrow F5.

At the evaporated fuel processing device 12 of the present exemplary embodiment, the evaporated fuel concentration of the gas that is exhausted from the canister 16 is detected at the concentration detector 38. Then, when it is judged at the ECU that the evaporated gas concentration has decreased and the purging of the canister 15 is substantially completed, the ECU stops the driving of the purge pump 40. Due thereto, because the purge pump 40 is not driven for a time longer than needed, wasteful consumption of electric power can be suppressed.

When the purge pump 40 is driven and the canister 16 is purged, and thereafter, the driving of the purge pump 40 is stopped temporarily, at the first separating film 42 and the second separating film 54, the thrust for causing the gasses, that are at the both sides (the high concentration chamber side and the low concentration chamber side) of these separating films, to pass through disappears, and therefore, the concentration gradient (difference in concentrations) at the both sides of the separating films gradually decreases. Due thereto, at the second separating film unit 20, the evaporated fuel concentration of the low concentration chamber 58 rises, and the evaporated fuel concentration of the low concentration gas pipe 72 also rises.

In this state, when the purge pump 40 is driven again and the canister 16 is purged, or the like, the ECU switches the solenoid switching valve 74 to the merge portion 34 side for a set time period. Due thereto, as shown by dashed-line arrow F8 in FIG. 3, the gas whose concentration has risen in the low concentration gas pipe 72 is sent from the solenoid switching valve 74 through the reflux pipe 76, the merge portion 82, the circulating pipe 60 and the exhaust pipe 28 to the first separating film unit 18, and is separated into the high concentration gas HG and the low concentration gas LG by the first separating film unit 18 and the second separating film unit 20. In this way, even if gas, whose concentration has risen to more than that of the original low concentration gas LG, exists within the low concentration gas pipe 72, this gas can again be separated into the high concentration gas HG and the low concentration gas LG by using the first separating film unit 18 and the second separating film unit 20. Then, after a set time period elapses, the evaporated fuel concentration of the gas within the low concentration gas pipe 72 decreases sufficiently, and is thought to become the concentration of the original low concentration gas LG. Therefore, the ECU switches the solenoid switching valve 74 to the canister 16 side, and sends the low concentration gas LG to the canister 16. Due thereto, sending, to the canister 16, of the gas whose concentration has risen within the low concentration gas pipe 72, and polluting of the canister 16, can be suppressed.

Figure 3:
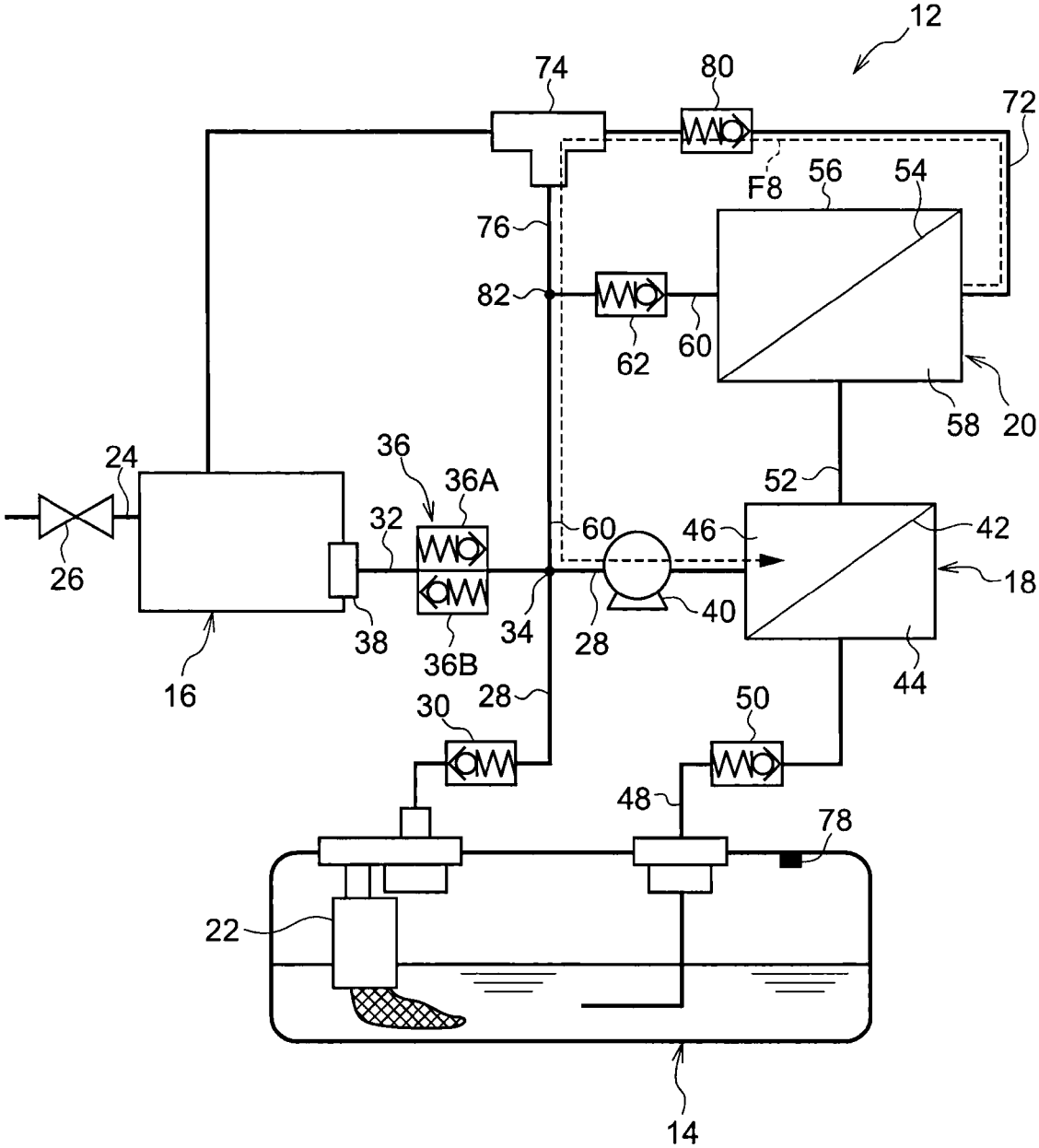
FIG. 3 is a schematic structural drawing showing the evaporated fuel processing device of the first exemplary embodiment of the present invention, together with the flow of gas in a state of processing the evaporated fuel.

Note that, in FIG. 1 through FIG. 3, the position of the portion where the reflux pipe 76 branches-off from the low concentration gas pipe 72 (substantially the position of the solenoid switching valve 74) is made to be at an intermediate portion of the low concentration gas pipe 72. However, in order to more reliably lower the concentration of the gas whose concentration has risen within the low concentration gas pipe 72, it is preferable for this branching-off portion to be positioned near to the canister 16.

Further, instead of the solenoid switching valve 74 that is a three-way valve, an opening/closing valve may be provided at each of the low concentration gas pipe 72 and the reflux pipe 76 at the downstream side of the branching-off portion. However, the structure can be simplified in the above-described exemplary embodiment in which a three-way valve is provided at the branching-off portion.

Figure 4:
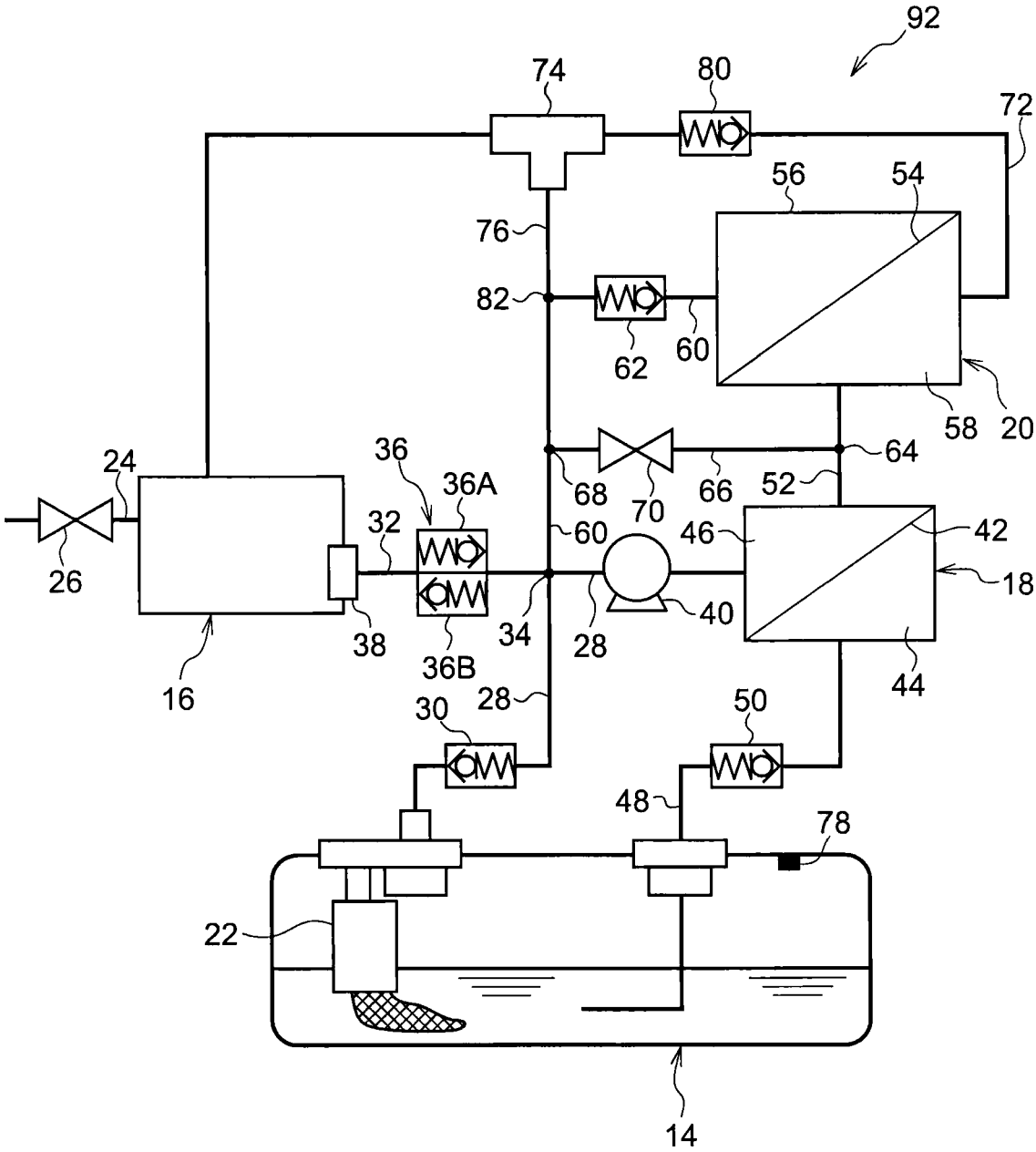
FIG. 4 is a schematic structural drawing showing an evaporated fuel processing device of a second exemplary embodiment of the present invention.

An evaporated fuel processing device 92 of a second exemplary embodiment of the present invention is shown in FIG. 4. Note that, in the second exemplary embodiment, structural elements, members, and the like that are the same as those of the first exemplary embodiment are denoted by the same reference numerals, and detailed description thereof is omitted.

In the evaporated fuel processing device 92 of the second exemplary embodiment, a branch portion 64 is set at the intermediate portion of the communication pipe 52. A medium concentration gas pipe 66 extends from the branch portion 64, and merges with the circulating pipe 60 at a merge portion 68. Namely, the medium concentration gas pipe 66 is connected to the exhaust pipe 28 (the purge pipe 32) at the upstream side of the purge pump 40.

The solenoid opening/closing valve 70, that is controlled so as to be opened and closed by the unillustrated ECU, is provided at the medium concentration gas pipe 66. Accordingly, due to the solenoid valve 70 being opened and the purge pump 40 being driven, the medium concentration gas MG that is generated at the low concentration chamber 46 of the first separating film unit 18 can be sent through the medium concentration gas pipe 66, the merge portion 68, the circulating pipe 60 and the exhaust pipe 28 to the low concentration chamber 46 of the first separating film unit 18. When the solenoid opening/closing valve 70 is closed, the medium concentration gas MG that is generated at the low concentration chamber 46 of the first separating film unit 18 can be sent to only the low concentration chamber 58 of the second separating film unit 20.

In the evaporated fuel processing device 92 of the second exemplary embodiment that is structured in this way, when fueling to the fuel tank 14 is carried out, the ECU sets the solenoid opening/closing valve 70 in a closed state, and then stops driving of the purge pump 40.

Figure 5:
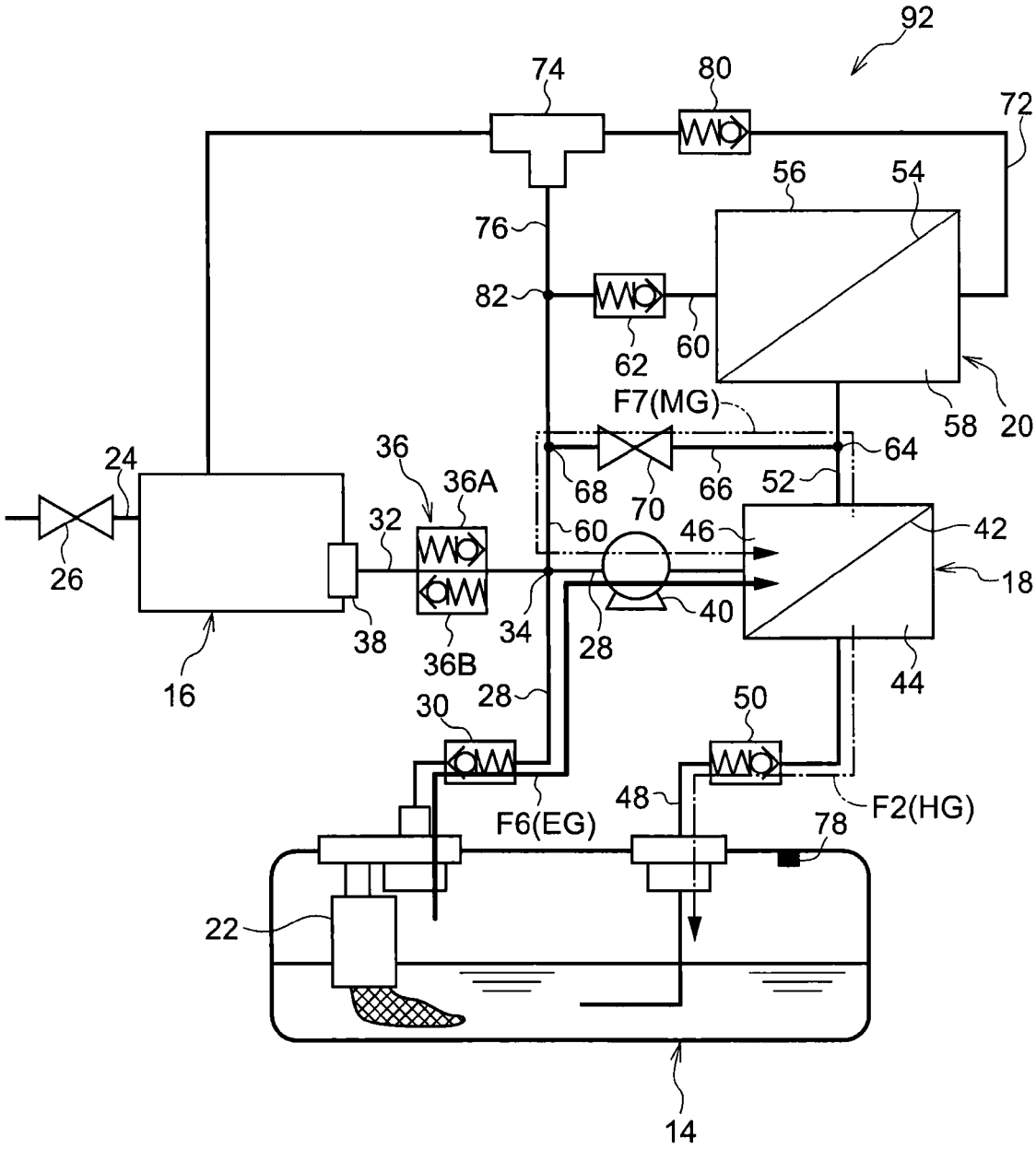
FIG. 5 is a schematic structural drawing showing the evaporated fuel processing device of the second exemplary embodiment of the present invention, together with the flow of gas in a state of processing the evaporated fuel.

In the state in which the canister 16 is purged, or the state in which purging of the canister 16 is substantially completed, there are cases in which the amount of evaporated fuel within the fuel tank 14 becomes large due to, for example, a rise in temperature or the like. In the evaporated fuel processing device 92 of the second exemplary embodiment, when it is judged that the concentration of evaporated fuel within the fuel tank 14 has risen, the ECU opens the solenoid opening/closing valve 70 and drives the purge pump 40. Due thereto, the gas within the fuel tank 14 is sent to the first separating film unit 18 as shown by solid-line arrow F6 in FIG. 5. Therefore, this gas is separated into the high concentration gas HG and the medium concentration gas MG, and after the high concentration gas HG is liquefied, the liquefied gas is returned to the fuel tank 14.

Because the solenoid opening/closing valve 70 is open at this time, the medium concentration gas MG that is generated at the low concentration chamber 46 of the first separating film unit 18 is sent, as shown by two-dot chain line arrow F7, from the branch portion 64 through the medium concentration gas pipe 66, the merge portion 68, the circulating pipe 60 and the exhaust pipe 28 to the low concentration chamber 46 of the first separating film unit 18. Then, liquefying and recovering of evaporated fuel to the fuel tank 14 can be carried out by using only the first separating film unit 18 (and not using the second separating film unit 20). There is substantially no need to cause pressure, that is for introducing gas into the second separating film unit 20, to be generated at the purge pump 40. Namely, the amount of electric power consumed by the purge pump 40 is reduced, and wasteful consumption of electric power can be suppressed.

Note that the above describes a structure in which the concentration detector 38 is provided in order to detect the evaporated fuel concentration of the gas that is exhausted from the canister 16. However, the structure that detects the evaporated fuel concentration of this gas is not limited to the concentration detector 38. For example, instead of the concentration detector 38, a flow meter that detects the flow amount of the gas that is exhausted from the canister 16 to the purge pipe 32 may be provided. In this structure, it suffices to consider that purging of the canister 16 is substantially completed when the detected flow amount reaches a predetermined value, and to stop the driving of the purge pump 40.

Further, the above describes an example in which the medium concentration gas pipe 66 branches-off from the branch portion 64 of the communication pipe 52, and merges with the circulating pipe 60 at the merge portion 68. However, it suffices for the medium concentration gas pipe 66 to, in effect, structure a flow path that sends the medium concentration gas MG, that is generated at the first separating film unit 18, to the upstream side of the purge pump. Accordingly, the medium concentration gas pipe 66 may be a structure that is directly connected from the low concentration chamber 46 of the first separating film unit 18 and merges with a portion of the exhaust pipe 28 at the upstream side of the purge pump 40. Moreover, the downstream side of the medium concentration gas pipe 66 may be directly connected to the low concentration chamber 46 of the first separating film unit 18, and a sending pump the medium concentration gas MG may be newly provided at the medium concentration gas pipe 66. However, in such structures, the medium concentration gas pipe 66 becomes longer or the need for a new pump arises, and therefore, there is the concern that such structures will lead to increase in weight and an increase in costs. In the structure of the above-described exemplary embodiment, a portion of the medium concentration gas pipe 66 can be used in common with the communication pipe 52 and the exhaust pipe 28, and there is no need to separately provide a new pump (the purge pump 40 is used). Therefore, the device can be made to be lighter-weight and lower-cost.

What is claimed is:

1. An evaporated fuel processing device comprising:

a fuel tank that can accommodate fuel;

a canister carrying out, by an adsorbent, adsorption and purging of evaporated fuel generated within the fuel tank;

a first separating unit that separates gas, which contains the evaporated fuel that is introduced from the canister or the fuel tank, into a high concentration component gas whose fuel concentration is relatively high and a low concentration component gas whose fuel concentration is relatively low;

a tank return flow path for returning, to an interior of the fuel tank, the high concentration component gas generated at the first separating unit;

a communication flow path for exhausting, to an exterior of the first separating unit, the low concentration component gas generated at the first separating unit;

a second separating unit that further separates the low concentration component gas, which is introduced from the communication flow path, into another high concentration component gas whose fuel concentration is relatively high and another low concentration component gas whose fuel concentration is relatively low;

a purging flow path for sending the other low concentration component gas, that is generated at the second separating unit, to the canister as vapor for purging;

an evaporated fuel return flow path that is branched-off from the purging flow path by a branch portion, and that is for returning, to the first separating unit, gas that contains evaporated fuel within the purging flow path;

a switching valve that switches a flow path of vapor that is downstream of the branch portion, between the purging flow path and the evaporated fuel return flow path; and a returning pump that pressurizes gas, which flows through the evaporated fuel return flow path, and that sends the gas to the first separating unit.

2. The evaporated fuel processing device of claim 1, wherein the switching valve is a three-way valve that is provided at the branch portion.

3. The evaporated fuel processing device of claim 1, further comprising:

a tank exhaust flow path for exhausting gas, that contains evaporated fuel within the fuel tank, to an exterior of the fuel tank and sends the gas to the first separating unit; and a sending pump that pressurizes gas, which flows through the tank exhaust flow path, and that sends the gas to the first separating unit, wherein the evaporated fuel return flow path merges with the tank exhaust flow path at an upstream side of the sending pump.

4. The evaporated fuel processing device of claim 3, wherein the sending pump also functions as the returning pump.

5. The evaporated fuel processing device of claim 3, further comprising:

an intermediate gas return flow path for returning, to the first separating unit, the low concentration component gas generated at the first separating unit; and an opening/closing valve that is provided at the intermediate gas return flow path and that opens and closes the intermediate gas return flow path, wherein the intermediate gas return flow path merges with the tank exhaust flow path at an upstream side of the sending pump.

* * * * *